US008851848B1

(12) United States Patent
Liang

(10) Patent No.: US 8,851,848 B1
(45) Date of Patent: Oct. 7, 2014

(54) TURBINE BLADE WITH SHOWERHEAD FILM COOLING SLOTS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 500 days.

(21) Appl. No.: 13/400,404

(22) Filed: Feb. 20, 2012

(51) Int. Cl.
*F01D 5/18* (2006.01)

(52) U.S. Cl.
USPC ..... 416/97 R

(58) Field of Classification Search
USPC ..... 415/115; 416/95, 96 R, 97 R, 232
See application file for complete search history.

(56) References Cited

U.S. PATENT DOCUMENTS

| | | | | |
|---|---|---|---|---|
| 4,992,025 | A * | 2/1991 | Stroud et al. | 416/97 R |
| 6,994,521 | B2 * | 2/2006 | Liang | 416/97 R |
| 2010/0040478 | A1 * | 2/2010 | Abdel-Messeh et al. | 416/97 R |
| 2010/0074763 | A1 * | 3/2010 | Liang | 416/97 R |

* cited by examiner

*Primary Examiner* — Edward Look
*Assistant Examiner* — Danielle M Christensen
(74) *Attorney, Agent, or Firm* — John Ryznic

(57) ABSTRACT

A turbine blade with a leading edge region of the airfoil having rows of film cooling slots each connected by one or more metering holes to a cooling air impingement cavity, where the film slots have both a convergent and a divergent shape. The side walls converge while the top and bottom walls diverge within each slot and form a very narrow but tall slot opening on the leading edge surface of the blade.

7 Claims, 5 Drawing Sheets

Line C-C

Line A-A
Prior Art

Line B-B
Prior Art

Line C-C

Line D-D

TURBINE BLADE WITH SHOWERHEAD FILM COOLING SLOTS

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to an air cooled turbine blade with leading edge film cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The first and second stage turbine stator vanes and rotor blades are exposed to the highest gas flow temperatures in the turbine, and therefore require film cooling of the external surfaces. The leading edge region of these airfoils is exposed to the highest gas flow temperatures on the airfoil. To provide film cooling for the leading edge region, a showerhead arrangement of film cooling holes is used. FIG. 1 shows a prior art blade with a cooling circuit that includes three rows of film cooling holes in a showerhead arrangement on the leading edge region with two rows of gill holes on both sides therefore. FIG. 2 shows a detailed view of the leading edge region with the film holes and gill holes. The middle row of film cooling holes is located at a stagnation line of the leading edge which is the location of the highest heat load on the airfoil. Cooling air from a supply channel 11 is metered through a row of metering holes 12 and into a leading edge impingement cavity 13 from which the showerhead film cooling holes 14 are supplied with the cooling air.

FIG. 3 shows a cross section view through the middle row of film cooling holes which are angled at from 20 to 35 degrees from the airfoil surface. The showerhead arrangement of film cooling holes in FIGS. 1-4 suffer from several disadvantages. The heat load on the blade leading edge region is parallel to the film cooling hole arrangement and thus reduces the cooling effectiveness. A portion of the film cooling holes within each film row is positioned behind each other (see FIG. 3) which reduces the effective frontal convection cooling area and conduction distance for the oncoming heat load. A realistic minimum film hole spacing to diameter ratio is around 3.0 such that below this ratio and cracking may occur for the film row. This results in a maximum achievable film coverage for that particular film row of 33% or 0.33 film effectiveness for each row of film cooling holes in the showerhead arrangement. Since the showerhead film cooling holes are at a radial orientation, the film pattern discharged from the film holes overlap with each other as depicted in FIG. 4. The film layer from the middle row flows over the film holes on the two outer rows and thus leaves a space 15 between film holes in the row that is uncovered. This is especially the case for a rotor blade because of the rotational effects on the film discharge.

BRIEF SUMMARY OF THE INVENTION

A turbine rotor blade with an airfoil having a leading edge region with rows of film cooling slots to provide better film cooling for the blade. Each film slot is connected through one or more metering holes to a cooling air impingement cavity. Each film slot includes a converging side and a diverging side where the two side walls converge and the top and bottom walls diverge.

The converging and diverging slots form a hole opening that is thin but tall in the spanwise direction of the blade. Each slot has a downstream cross section flow area greater than an upstream cross section flow area, with the upstream cross section flow area being from two to five times a cross section flow are of the metering holes.

DETAILED DESCRIPTION OF THE INVENTION

Figure 5:
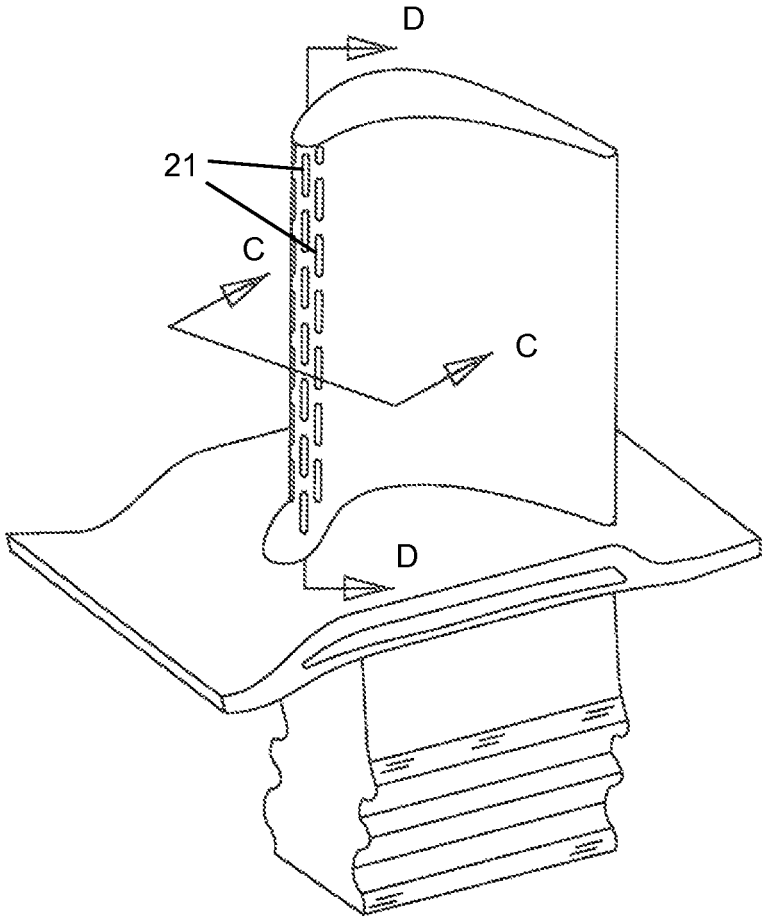
FIG. 5 shows an isometric view of a turbine rotor blade with the rows of film cooling slots in the leading edge region of the present invention.

The present invention is a film cooling slot design for a leading edge region of a turbine rotor blade that is exposed to a relatively high gas flow temperature. FIG. 5 shows a view of a turbine blade with the leading edge region having multiple rows of film cooling slots 21 according to the present invention. In this embodiment, three rows of film cooling slots 21 are used. The slots 21 open onto the airfoil surface with a narrow width and a tall spanwise height. Adjacent rows of slots 21 are also offset so that adjacent slots are not aligned as seen in FIG. 5.

Figure 6:
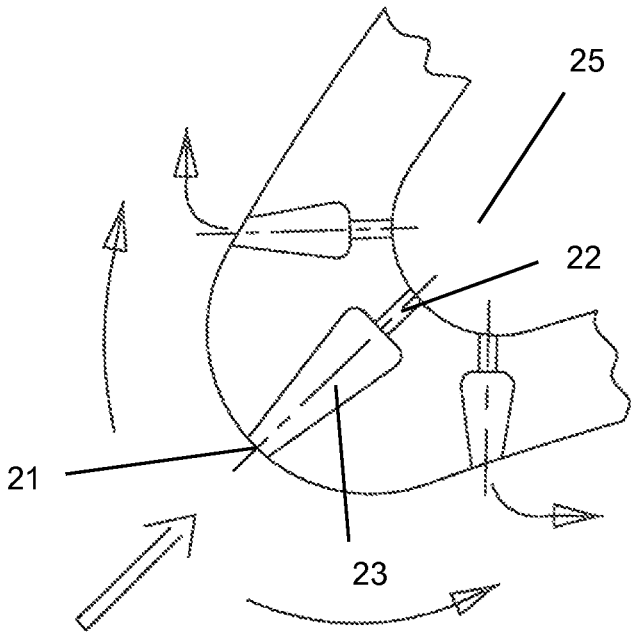
FIG. 6 shows a cross section top view of the film cooling slots of the present invention through line C-C in FIG. 5.

FIG. 6 shows a cross section top view of the film cooling slots of FIG. 5. Each slot includes the opening 21, a thin convergent and divergent metering diffusion slot 23 and one or more metering holes 22 connected to a cooling air supply channel or cavity 25. As seen in FIG. 6, the side walls of the convergent and divergent slot 23 are converging. As seen in the FIG. 7 cross section side view, the convergent and divergent slots 23 are diverging in the spanwise or radial direction of the airfoil. Thus, the convergent and divergent slots 23 are converging in the airfoil chordwise direction while diverging in the airfoil spanwise direction.

Each of the convergent and divergent film slots 23 is constructed as an individual modulus in order that the individual convergent and divergent metering diffusion slots can be designed based on the airfoil gas side pressure distribution in both the spanwise and chordwise directions. Also, each individual convergent and divergent metering diffusion slot can be designed based on the airfoil local external heat load in order to achieve a desired local metal temperature. Each convergent and divergent metering diffusion film slot is oriented in a staggered overlapping formation relative to each other along the airfoil leading edge and against the mainstream hot gas flow.

Figure 1:
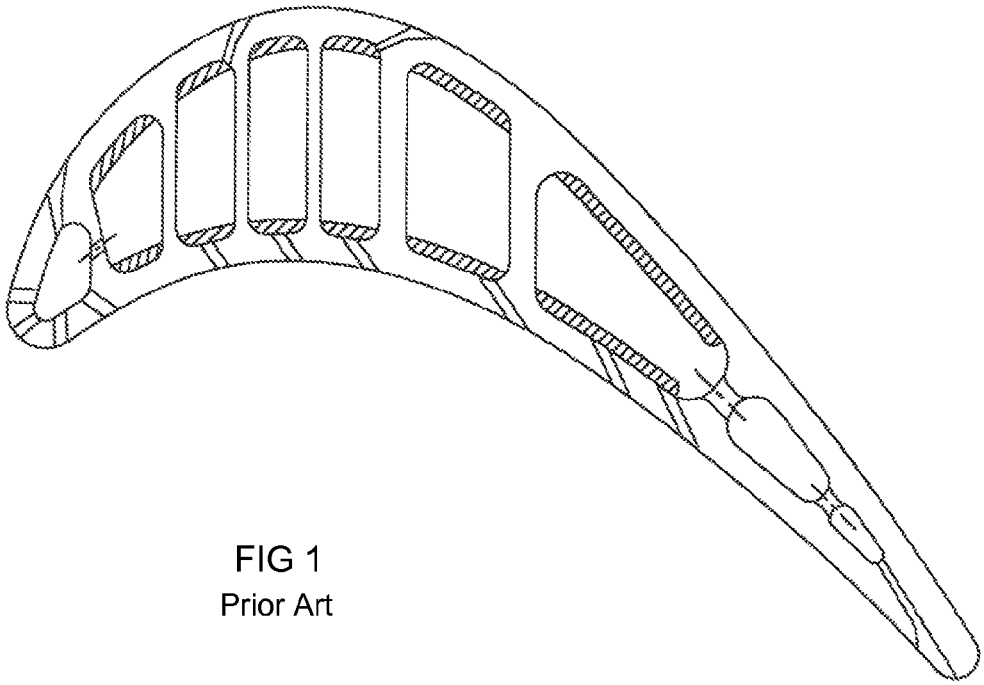
FIG 1 Prior Art
FIG. 1 shows a cross section view of a prior art turbine blade with a cooling circuit.
Figure 2:
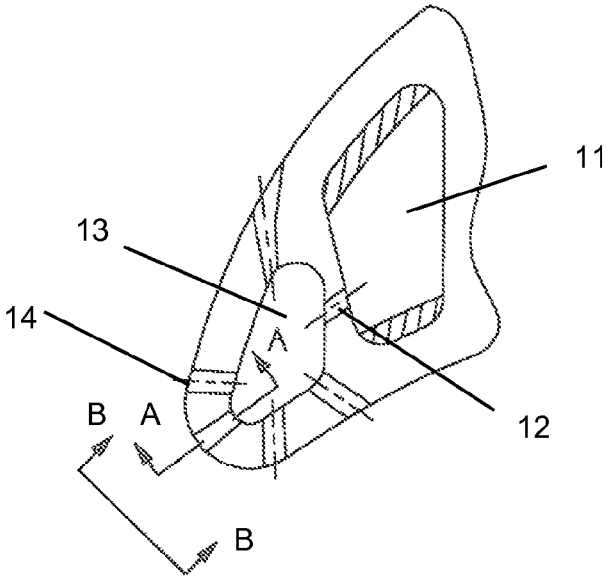
FIG 2 Prior Art
FIG. 2 shows a detailed view of the leading edge region of the FIG. 1 prior art turbine blade with a showerhead arrangement of film cooling holes and gill holes.
Figure 3:
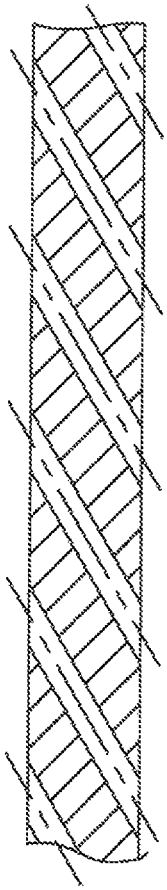
FIG. 3 shows a cross section view of the middle row of film cooling hole through the line A-A in FIG. 2.
Figure 4:
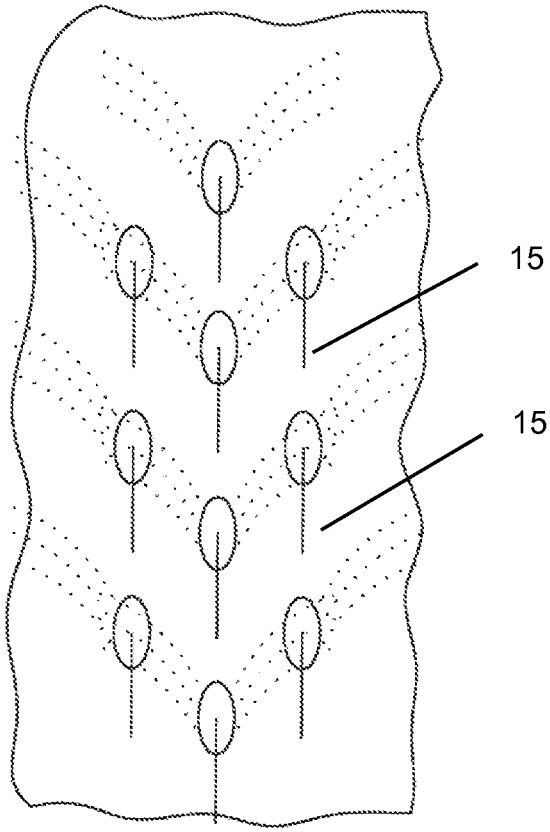
FIG. 4 shows a front view of a section of the leading edge region of the blade through line B-B in FIG. 2.
Figure 7:
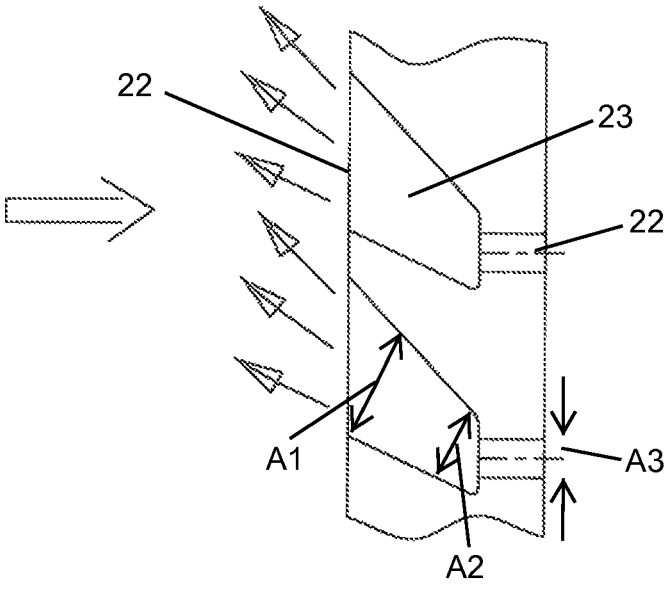
FIG. 7 shows a cross section side view of the film cooling slots of the present invention through line D-D in FIG. 5.

The thin convergent and divergent metering diffusion film slots each include a metering flow section at the inlet end. The metering hole 22 can be a single hole or a number of metering holes opening into the individual slot 23. The film slots are convergent in the chordwise direction (FIG. 6) and divergent in the spanwise direction (FIG. 7). The divergent sidewalls create diffusion in the airfoil streamwise flow direction to further elongate the film cooling slot exit opening at the airfoil surface. This results in a thin slot opening onto the airfoil surface that spreads out the cooling flow onto the airfoil surface and provides a better film coverage on the airfoil surface and a higher film effectiveness. The elongated and overlapping film slot design will eliminate the film flow maldistribution issues associated with the prior art film cooling holes referred to in FIG. 4.

It is not necessary that the cooling flow area contraction due to the sidewall convergence be the same as the cooling flow area in the spanwise divergence. The cooling flow exit area (A1) at the downstream end should be greater than the cooling flow area (A2) at the upstream end. However, the cooling flow area (A1) should be from two to five times that of the metering hole area (A3). The convergence of the sidewalls creates an elongation for the film cooling slot in the spanwise direction. This forms the film slot from a wide and short entrance section to a thin and elongated opening onto the airfoil surface.

I claim:

1. An air cooled turbine rotor blade comprising:

an airfoil with a leading edge region;

a leading edge impingement cavity located in the leading edge region;

a row of film cooling slots in the leading edge region extending along a spanwise direction of the airfoil;

a metering hole connected each of the film cooling slots to the leading edge impingement cavity;

each of the film cooling slots having two side walls that form a divergent cooling air flow; and, each of the film cooling slots having a top and bottom wall that form a convergent cooling air flow.

2. The air cooled turbine rotor blade of claim 1, and further comprising:

each of the film cooling slots is connected to a plurality of metering holes.

3. The air cooled turbine rotor blade of claim 1, and further comprising:

the airfoil includes three rows of film cooling slots with a middle row along a stagnation line of the airfoil and one row of each of the two sides of the middle row.

4. The air cooled turbine rotor blade of claim 1, and further comprising:

the film cooling slots have a downstream cross section flow area that is from two to five times a cross section flow area of the metering holes.

5. The air cooled turbine rotor blade of claim 1, and further comprising:

the film cooling slots are angled in a radial upward direction toward a blade tip.

6. The air cooled turbine rotor blade of claim 1, and further comprising:

the film cooling slots have openings on the airfoil surface with a thin width and a tall spanwise height.

7. The air cooled turbine rotor blade of claim 1, and further comprising:

the film cooling slots have a downstream cross section flow area that is greater than an upstream cross section flow area formed within the slot.

* * * * *